US007196460B2

(12) United States Patent
Kling

(10) Patent No.: US 7,196,460 B2
(45) Date of Patent: Mar. 27, 2007

(54) INCANDESCENT REFLECTOR HEAT LAMP WITH UNIFORM IRRADIANCE

(75) Inventor: Michael R. Kling, Lexington, KY (US)

(73) Assignee: Osram Sylvania Inc., Danvers, MA (US)

( * ) Notice: Subject to any disclaimer, the term of this patent is extended or adjusted under 35 U.S.C. 154(b) by 301 days.

(21) Appl. No.: 10/883,078

(22) Filed: Jul. 1, 2004

(65) Prior Publication Data

US 2006/0002112 A1 Jan. 5, 2006

(51) Int. Cl.

| | |
|---|---|
| ***H01J 5/16*** | (2006.01) |
| ***H01J 61/40*** | (2006.01) |
| ***H01K 1/26*** | (2006.01) |
| ***H01K 1/30*** | (2006.01) |

(52) U.S. Cl. ..... 313/113; 313/116

(58) Field of Classification Search ..... 313/111, 313/113, 116; 362/296, 309, 329, 336, 518
See application file for complete search history.

(56) References Cited

U.S. PATENT DOCUMENTS

| | | | | |
|---|---|---|---|---|
| 2,770,716 A * | 11/1956 | Kingery | 362/518 |
| 3,267,278 A * | 8/1966 | Doolittle | 362/309 |
| 3,807,834 A * | 4/1974 | Nagel | 359/628 |
| 4,545,007 A * | 10/1985 | Nagel | 362/329 |
| 4,785,385 A * | 11/1988 | Holst | 362/309 |
| 4,912,613 A * | 3/1990 | Sanborn | 362/336 |
| 4,991,073 A * | 2/1991 | Levin | 362/309 |
| 5,043,856 A | 8/1991 | Levin | 362/309 |
| 5,442,252 A * | 8/1995 | Golz | 313/111 |
| D381,455 S * | 7/1997 | Gallant | D26/123 |
| 6,086,227 A | 7/2000 | O'Connell et al. | 362/297 |
| 6,369,492 B1 * | 4/2002 | Sugimoto | 313/113 |

* cited by examiner

*Primary Examiner*—Joseph Williams
*Assistant Examiner*—Kevin Quarterman
(74) *Attorney, Agent, or Firm*—Carlo S. Bessone

(57) ABSTRACT

An infrared heat lamp has a reflector body closed by a lens and having a source of infrared radiation positioned within the body. The lens has a plurality of lenticules formed thereon to provide substantially uniform radiant intensity within a 50° cone on a planar surface spaced from the lens, the radiant intensity varying as the inverse of $(\cos \beta)^2$. In a preferred embodiment all of the lenticules have a parabolic shape.

2 Claims, 4 Drawing Sheets

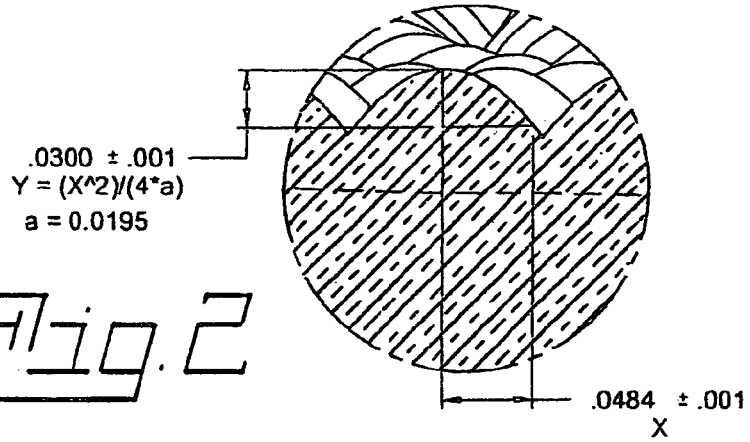
Fig. 2
Fig. 3
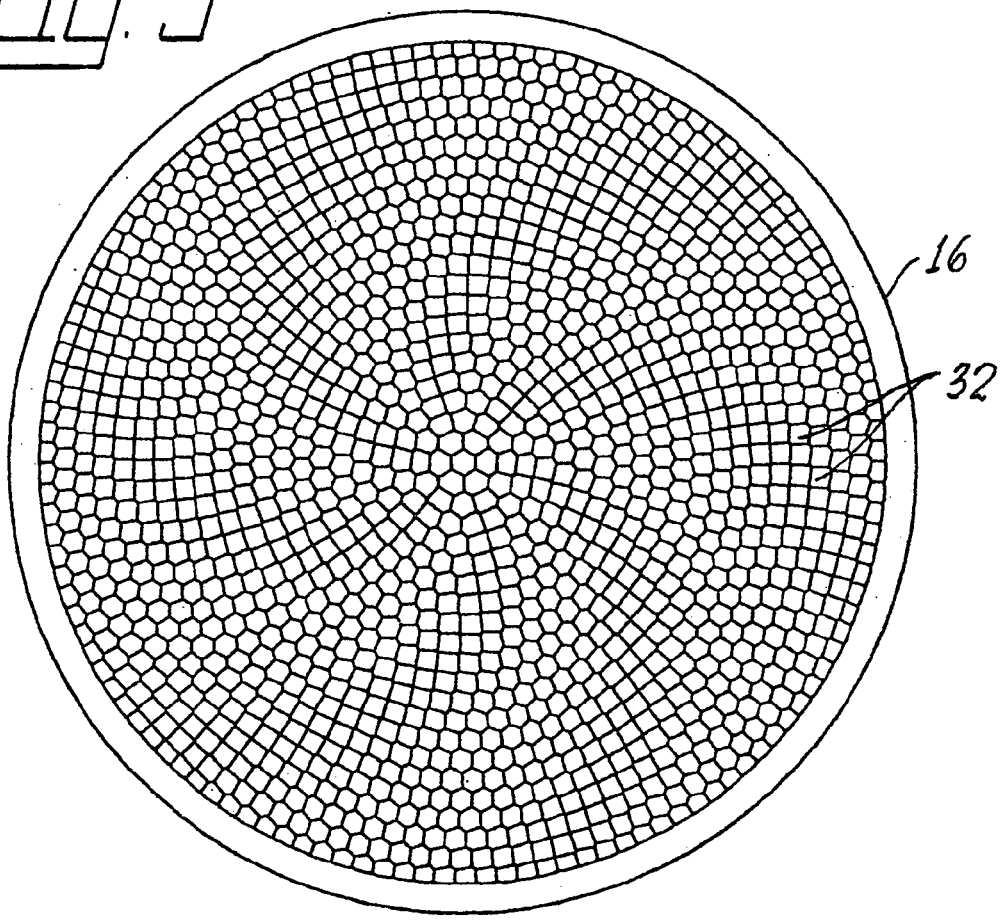

INCANDESCENT REFLECTOR HEAT LAMP WITH UNIFORM IRRADIANCE

TECHNICAL FIELD

This invention relates to incandescent lamps and more particularly to such lamps employed as radiant heat sources.

BACKGROUND ART

Directional infrared heat lamps are commonly available as BR40 or R-40 lamps having envelopes made from soft glass. Additionally, it is known to make such lamps in PAR38 format from pressed hard glass reflector and lens components. These lamps are often used in agricultural or industrial applications where it is desired that a relatively large flat surface must be uniformly heated. However, presently available heat lamps usually do not perform the desired function well because the lamps have a non-uniform power distribution with maximum radiant intensity on axis dropping to 50% of peak within about 15 degrees of the lamp axis. The radiant beam angle in such cases is about 30 degrees.

The current models of such heat lamps have been based upon the standard lamps designed for general lighting purposes and use most of the same components to keep costs down. The BR40 and R-40 lamps realize some beam spread by use of a frosted inner surface so the maximum bean spread is very limited. The PAR38 lamps can incorporate optical elements in both the reflector and lens and offer much greater control of radiant beam distribution. The available PAR38 general lighting and infrared heat lamps use a reflector that provides only a small amount of beam spread. Most of the spreading is effected by the lens, which is typically formed of a plurality of spherical protrusions or lenticules. For incandescent coil PAR38 lamps with proper design of spherical lenticule radius and layout, a beam spread of nearly 50 degrees can be achieved. Such optics can give a fairly broad flat peak dropping 50% of peak at 25 degrees off-axis. It is not possible to achieve a large area of uniform irradiance on a flat surface using conventional lens optics with spherical lenticules. Futhermore, this type of light distribution is not normally required or desired in general lighting applications.

Even with an isotropic radiating lamp, the irradiance on a flat surface normal to the lamp axis is not uniform and drops substantially with distance from the center because of the inverse square law and the cosine law of illumination. For a point source, the irradiance on a surface is described by $E=I/D^2 \cdot \cos \beta$ (Equation 1)

Where: I=radiant intensity, D=distance from the source, E=irradiance, $\beta$=angle from normal From this equation it can be shown that for uniform intensity, irradiance fall as $\cos^2$ of the angle from normal. For some applications, it is desirable to have a uniform irradiance or a circular flat surface defined by a 50 degree solid angle. A heat lamp of conventional design with the widest possible beam spread, has at least a 60% fall-off in irradiance between center and edge. Most commercially available heat lamps have a much greater variation. This results in a non-uniform temperature distribution across the target area within a 0.6 steradian zone.

DISCLOSURE OF INVENTION

It is, therefore, an object of the invention to obviate the disadvantages of the prior art.

It is another object of the invention to enhance infrared heat lamps.

It is yet another object of the invention to provide an infrared heat lamp that cancels the normal $\cos^2$ drop in irradiance.

These objects are accomplished, in one aspect of the invention, by an infrared heat lamp that comprises a reflector body closed by a lens and having a source of infrared radiation positioned within the body, the lens having a plurality of lenticules formed thereon to provide substantially uniform radiant intensity within a 50° cone on a planar surface spaced from said lens, said radiant intensity varying as the inverse of $(\cos \beta)^2$.

BRIEF DESCRIPTION OF THE DRAWINGS

FIG. 2 is an enlarged sectional view of lenticules that can be used with the invention;

FIG. 3 is plan view of a lenticule arrangement;

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
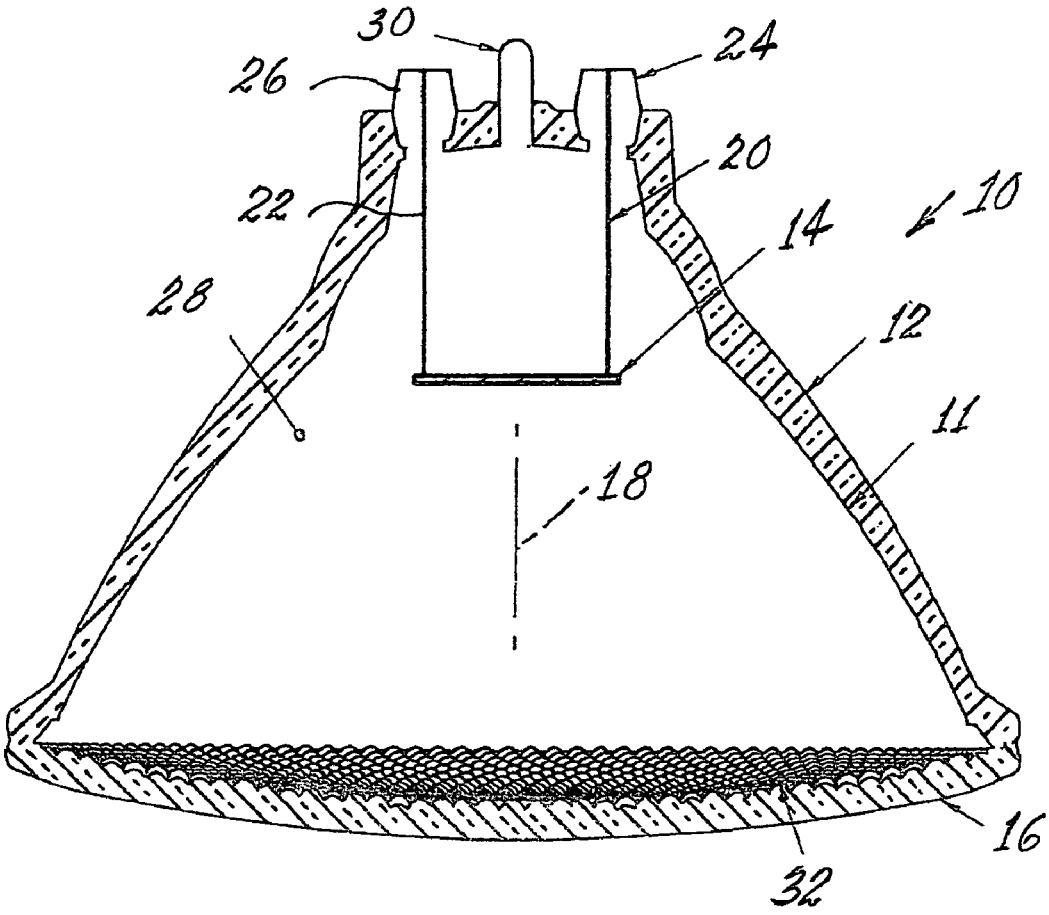
FIG. 1 is an elevational view, in cross-section, of a heat lamp employing an embodiment of the invention.

Referring now to the drawings with greater particularity, there is shown in FIG. 1 a cross-section of an embodiment of the invention comprising an infrared emitting heat lamp 10 having a body 12 sealed to a lens 16. At least a portion of the inner reflector part 11 of body 12 has a parabolic configuration. This inner reflector part 11 can be coated with aluminum or other reflective material. An infrared heat source, such as a tungsten coil 14 is positioned near the focal point of the parabolically shaped reflector part 11 so that a substantial portion of the radiated power has a direction parallel to the lamp axis 18. The radiating source 14 is supported by in-lead wires 20, 22, which are brazed or otherwise affixed to metallic ferrules 24, 26, which are hermetically sealed to the reflector body 12.

Electric power is conducted through the ferrules 24, 26 to the lead-in wires 20, 22 from a source, not shown, to the tungsten coil 14. The enclosed body volume 28 typically contains an inert gas such as nitrogen or argon or a mixture thereof. Air is exhausted and the inert fill supplied through an exhaust tube 30, which is then sealed off to provide a hermetic seal. A typical metal base, such as an Edison screw base, is then attached to the bottom of the body 12 and wired to the ferrules and serves as the conductor to the electrical supply.

The lens 16 is provided on its inner surface with a plurality of lenticules 32. In a preferred embodiment of the invention the lenticules have a parabolic configuration. These lenticules can be described as the revolution about an axis of the line defined by $Y=X^2/4a$ (Equation 2), where "a" is the focal length of the parabola.

Lenticule shapes other than parabolic can be employed. For example, lenticule shapes between parabolic and conical may also provide the desired intensity distribution. Such shapes can be defined by the relationship $Y=X^N/4a$ (Equation 3), where "N" is greater than 1 and less than or equal to 2.

The lenticules 32 can be arrayed on the inner surface of the lens in a closely packed hexagonal grid; however, a more uniform and round irradiance pattern can be achieved by arranging the lenticules in concentric rings as shown in FIG. 3.

By way of example, one particular application for a heat lamp requires that a 20 inch diameter circular area be heated uniformly by a lamp with a lens surface 20 inches above the flat surface. According to Equation 1, the ideal radiant intensity distribution will have maximum intensity at about 25 degrees from the lamp axis and the radiant intensity at center beam will be about 20% lower. This is only an approximation because the close spacing of the lamp and illuminated surface complicates the relationship. Parabolic lenticules of focal length 0.0195inches were found to give the desired intensity distribution with lenticule row spacing of 0.105 inches and circumferential lenticule spacing of about 0.112 inches. The critical parameters are the exponent "N" and the ratio of the inverse focal length 1/a to the average lenticule spacing "b". Lower values of "N" result in greater difference between peak and axial intensity. Higher ratios of inverse focal length to lenticule spacing give a broader radiant beam angle or area of uniform irradiance; however, the high ratios become difficult to manufacture. For an exponent of 2, the optimum focal length "a" is about 0.00215/b. A useful range of lenticule spacing for PAR38 lamps is about 0.040 to 0.40 inches and the useful focal length is 0.0015/b to 0.005/b.

Figure 4:
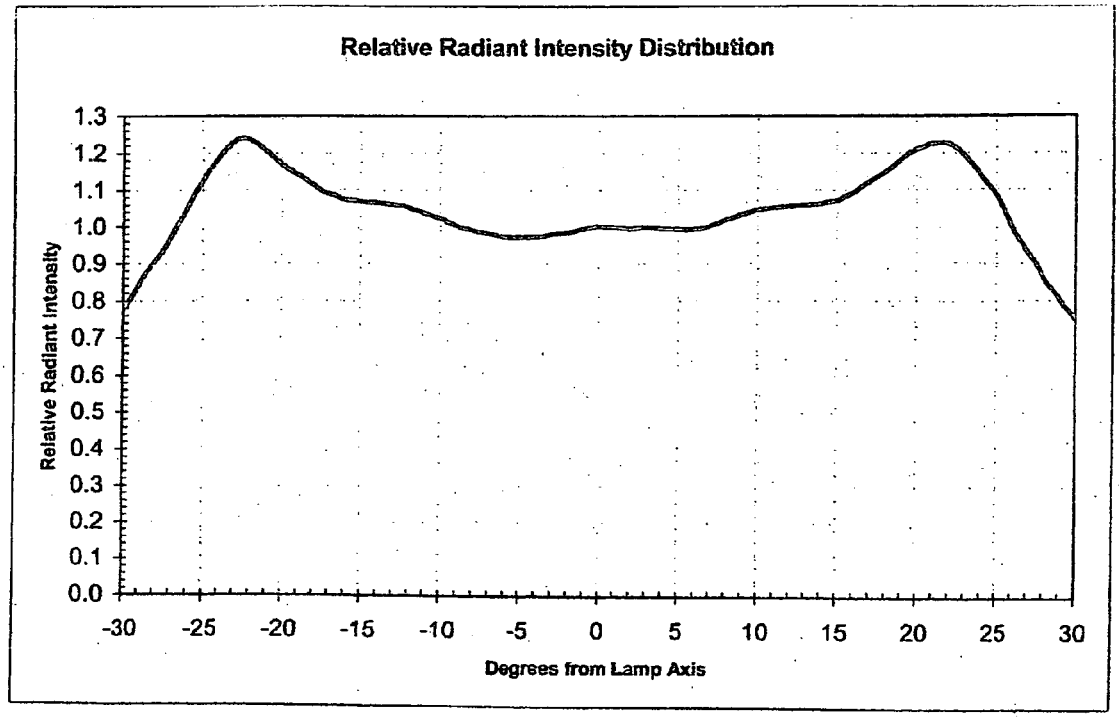
FIG. 4 is a graph of relative radiant intensity distribution of a plurality of lamps employing the invention.

As an experiment, PAR38 lenses were made to the preferred embodiment using spiral concentric rings of parabolic lenticules with focal length 0.0195 inches, "N"=2, and the average lenticule spacing at closest point of 0.108 inches. The lenses were used to make 175 W, 120V heat lamps. The relative intensity distribution of these lamps is shown in FIG. 4. The graph represents the average of 6 lamps and the distribution is reasonably close to the ideal intensity distribution defined by Equation 1.

Figure 5:
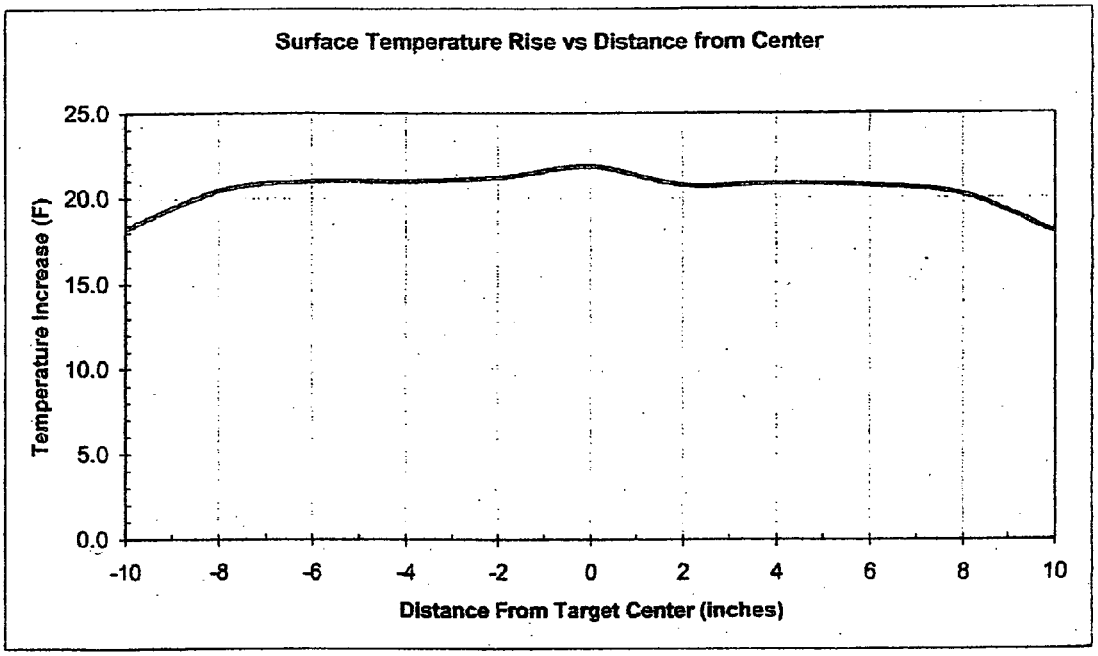
FIG. 5 is a graph of the temperature distribution.

As a further test, the heat distribution provided by these lamps was also measured using an array of black copper disks positioned 20 inches below the lamp on a thermally insulating surface. The disk temperature rise above ambient was measured using type K fine wire thermocouples attached to the underside of the disks. Temperature measurements were taken in a draft-free room at 74° F. after thermal equilibrium was reached. The temperature distribution is shown in FIG. 5. Surface temperature varied by less than 5° F. (~20%) over the entire area of interest and by only 2° F. (10%) over a 17 inch diameter circular area.

Infrared heat lamps providing uniform irradiance can be made in other lamps shapes and sizes and any source emitting infrared and/or visible radiation can be used. Reflector shapes other than parabolic could also be effective but would require different parameters for the parabolic lenticules.

While there have been shown and described what are present considered to be the preferred embodiments of the invention, it will be apparent to those skilled in the art that various changes and modifications can be made herein without departing from the scope of the invention as defined by the appended claims.

What is claimed is:

1. An infrared heat lamp comprising:

a reflector body closed by a lens and having a source of infrared radiation positioned within said body, said lens having a plurality of lenticules formed thereon to provide substantially uniform radiant intensity within a 50° cone on a planar surface spaced from said lens, said radiant intensity varying as the inverse of $(\cos \beta)^2$, said lenticules have a shape of a parabola defined as the revolution about an axis of a line conforming to $Y=X^2/4a$, where "a" is the focal length of the parabola.

2. An infrared heat lamp comprising:

a reflector body closed by a lens and having a source of infrared radiation positioned within said body, said lens having a plurality of lenticules formed thereon to provide substantially uniform radiant intensity within a 50° cone on a planar surface spaced from said lens, said radiant intensity varying as the inverse of $(\cos \beta)^2$, said lenticules have a shape defined as the revolution about an axis of a line conforming to $Y=X^N/4a$, where "a" is the focal length of the arc and "N" is greater than 1 and less than or equal to 2.

* * * * *